US006145664A

United States Patent [19]

Cope

[11] Patent Number: 6,145,664

[45] Date of Patent: Nov. 14, 2000

[54] CONTAINER

[75] Inventor: Andrew Christopher Cope, Wednesbury, United Kingdom

[73] Assignee: McKechnie UK Limited, West Midlands, United Kingdom

[21] Appl. No.: 09/204,831

[22] Filed: Dec. 3, 1998

[30] Foreign Application Priority Data

Dec. 3, 1997 [GB] United Kingdom ..... 9725564

[51] Int. Cl.[7] ..... B65D 21/00

[52] U.S. Cl. ..... 206/506; 206/503

[58] Field of Search ..... 206/503, 506

[56] References Cited

U.S. PATENT DOCUMENTS

| | | | |
|---|---|---|---|
| 4,105,117 | 8/1978 | Atkin et al. . | |
| 4,391,369 | 7/1983 | Stahl et al. | 206/506 |
| 4,573,577 | 3/1986 | Miller | 206/506 |
| 4,947,992 | 8/1990 | Schafer | 206/506 |
| 5,772,033 | 6/1998 | Loffus et al. | 206/506 |

FOREIGN PATENT DOCUMENTS

| | | |
|---|---|---|
| 1 128 878 | 8/1982 | Canada . |
| 0 553 540 | 8/1993 | European Pat. Off. . |
| 0 585 575 A2 | 3/1994 | European Pat. Off. . |
| 2 392 891 | 12/1978 | France . |
| 19 49 637 | 11/1996 | Germany . |
| 2 264 102 | 8/1993 | United Kingdom . |

*Primary Examiner*—Steven Pollard
*Attorney, Agent, or Firm*—Adams, Schartz & Evans, P.A.

[57] ABSTRACT

A container 10 has walls 14 and a support member 16 in the form of a stacking bar. The bar 16 is mounted by a plate 20, slot 22 and pin 24 to move between different stacking positions providing multiple height stacking. At the lowest position shown, the weight of a container stacked on the bar 16 is transferred to the container wall 14 by a finger 40 at a higher position, where the container wall is stronger and thus better able to bear the weight.

6 Claims, 3 Drawing Sheets

CONTAINER

The present invention relates to containers.

TECHNICAL FIELD AND BACKGROUND OF THE INVENTION

A conventional form of stacking and nesting container comprises two bail arms, stacking bars or support bars pivotally attached to and extending between the sides of the container, usually at opposing ends of the container. Each stacking member can be moved from a nesting position (in which a like container can nest from above) to a position in which it can support a second like container, to form a stack.

It has been proposed to provide two stacking heights for the stacking member, to make more efficient use of the container volume, particularly when only partially filled. An example is disclosed in our British Patent No. GB 2264102B.

SUMMARY OF THE INVENTION

The present invention provides a container comprising a support member mountable on said container at a stacking position to support a second container rested on the support member to form a stack, and mounting means by which the support member is mounted on said container, the mounting means being so formed and arranged as to transfer the weight of a second container from the support member to a remote position at which the container is better able to bear the weight.

Preferably the container comprises a base and upwardly extending walls. The mounting means may transfer weight to a wall of the container, preferably at a different height to the stacking position. Preferably the said different height is above the stacking position.

Preferably the walls have a strengthened region, the transferred weight being transferred to a position within or above the strengthened region. The strengthened region is preferably the upper rim of the wall and preferably provides a nesting stop to limit downward movement of a container into another like container when nesting.

Preferably there are a plurality of stacking positions to which the support member may move to support a second container at respective heights above the base, the mounting means transferring weight as aforesaid at least when the support member is in the lowermost of the stacking positions. The mounting means preferably transfers weight to a formation which defines another stacking position. The formation may comprise a ledge on which a portion of the mounting means or support member may rest when in the corresponding stacking position, and on which an alternative portion may rest when in a different stacking position, to transfer weight as aforesaid.

Preferably at least two, preferably three stacking positions are provided and the support member may also be movable to a nesting position in which the support member allows a second container to be nested in the container.

BRIEF DESCRIPTION OF THE DRAWINGS

One embodiment of the present invention will now be described in more detail, by way of example only, and with reference to the accompanying drawings in which.

DESCRIPTION OF THE PREFERRED EMBODIMENT AND BEST MODE

Figure 1:
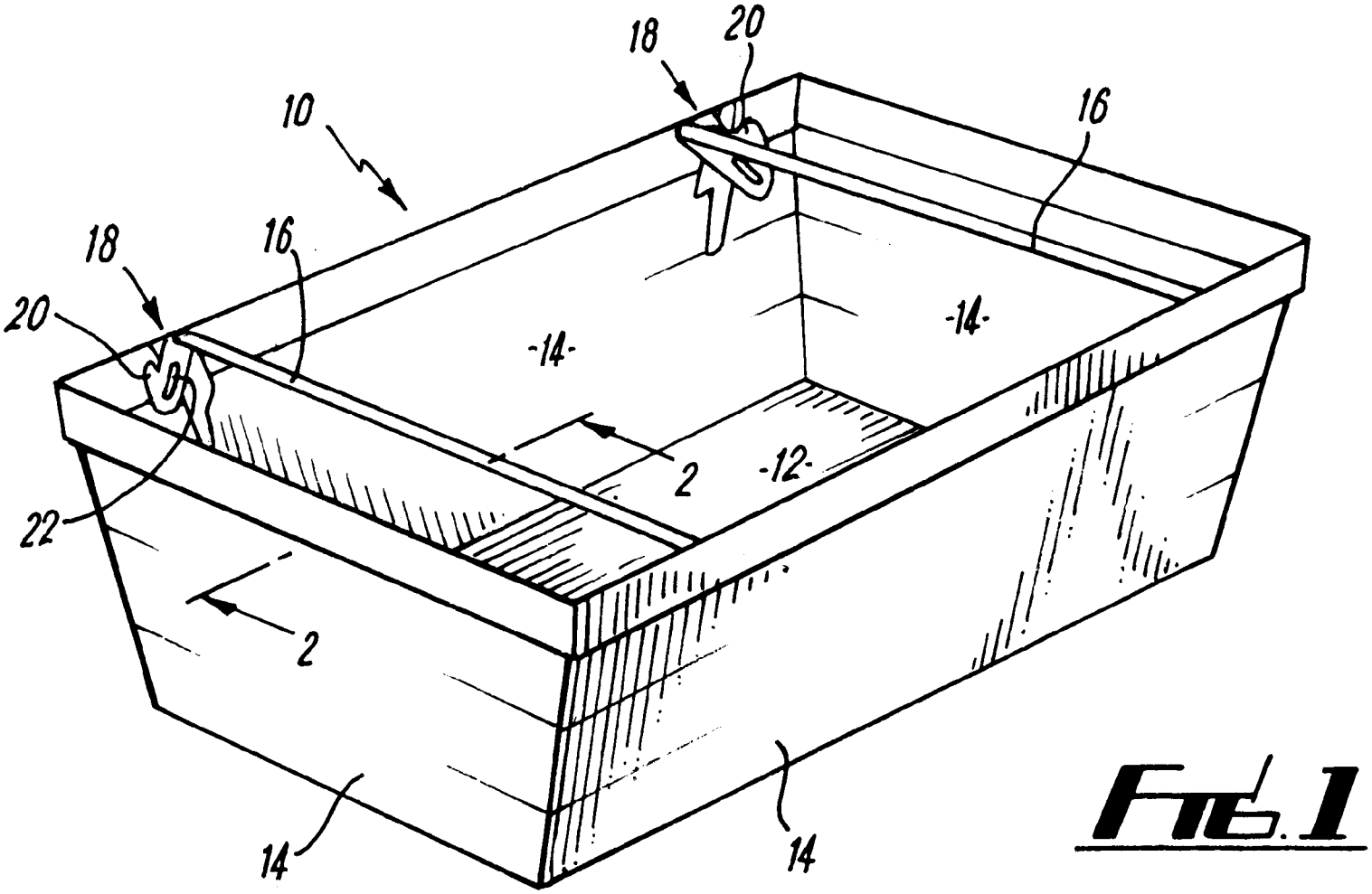
FIG. 1 is a highly schematic perspective view of a container according to the present invention.

Turning to FIG. 1, there is shown a container 10 comprising a base 12 and upwardly extending side walls 14. Support members 16 (hereafter called stacking bars) are mounted on the container 10 and have a stacking position to support a second container rested on the support member to form a stack. In FIG. 1, the bars 16 are shown at their uppermost stacking position.

Figure 2:
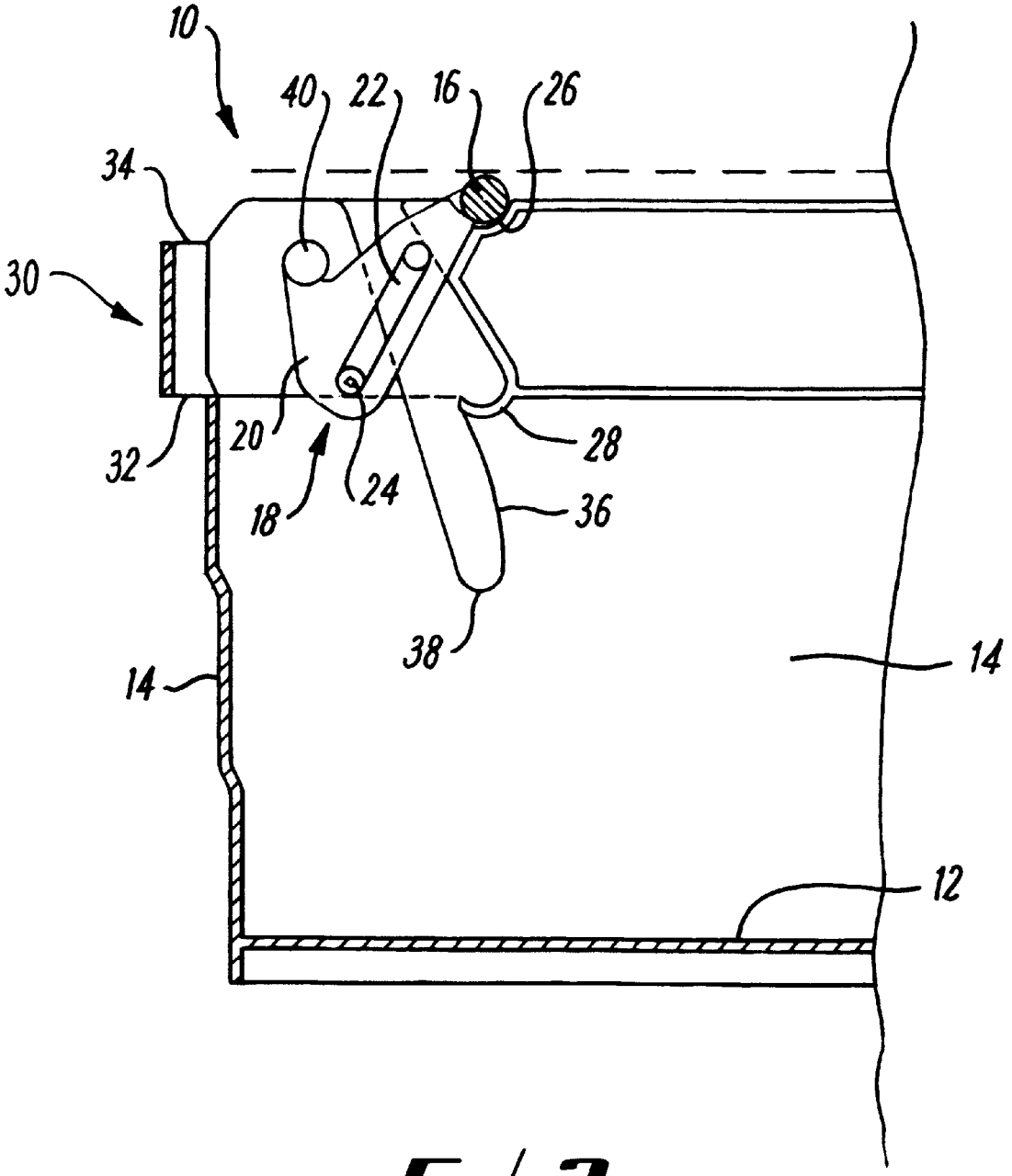
FIG. 2 is a partial vertical section along the line 2—2 of FIG. 1.

In more detail, with reference to FIG. 2, one bar 16 is shown together with associated mounting means 18 by which the bar 16 is mounted on the container 10. A corresponding arrangement is provided at the other end of the container, for the other bar 16.

The mounting arrangement 18 consists of a plate 20 at the end of the bar 16 and having a slot 22 in which a pin 24 is located. The pin is formed integrally with, or is attached to the wall 14 and has an oversize head to retain the pin 24 in the slot 22. The pin and slot 24,22 allows the plate 20 to move relative to the wall 14, either by sliding the slot 22 past the pin 24, or pivoting the plate 20 around the pin 24, or by a combination of these movements.

The mounting arrangement 18 further comprises a ledge 26 formed in the wall 14 and having slightly cupped upper surfaces. The bar 16 may rest on the ledge 26 at a point close to or at the end of the bar 16. Alternatively, the bar 16 could project beyond the plate 20 toward the wall 14, the resultant short projection being movable to rest on the ledge 26. Alternatively, a projection or other formation could be provided on the plate 20, not necessary aligned with the bar 16, but having a cooperating formation formed on the wall 14. Whichever of these or other equivalent alternatives is chosen, the arrangement allows the bar 16 to be supported at an uppermost (FIG. 1) stacking position so that another like container can be stacked on the container 10 with the base of the upper container at the level of the upper mouth of the container 10. This is illustrated in FIG. 2 highly schematically, by the use of broken lines.

Figure 3:
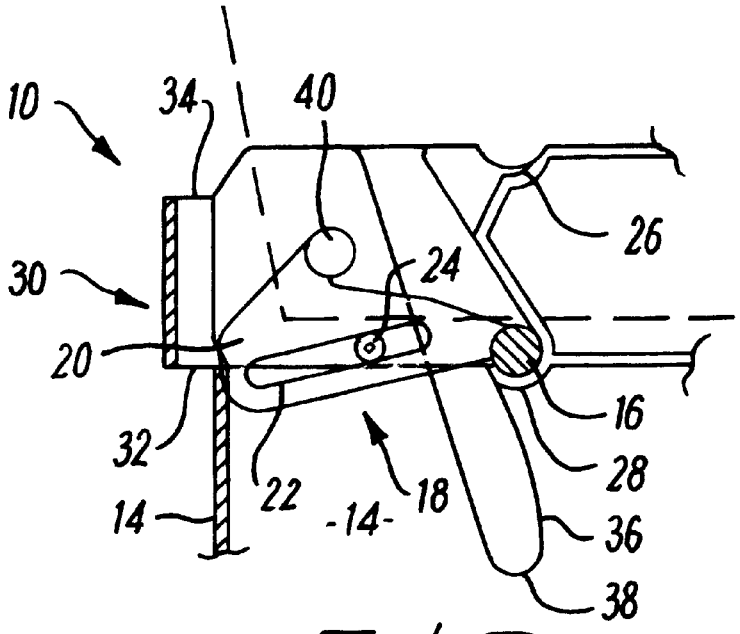
FIGS. 3 and 4 correspond to FIG. 1 and show the arrangement in an alternative condition.

A second ledge 28 is provided below the ledge 26, as shown in FIG. 3. Manipulation of the plate 20, by virtue of the pin and slot connection 22,24 allows the bar 16 to be moved to a lower position in which the ledge 28 is engaged in the same manner as has been described above in relation to the ledge 26, thereby providing a second stacking position lower than the one described in relation to FIG. 2. Again, broken lines are used to indicate highly schematically the approximate position of the base of another like container stacked when the bar is in the position shown in FIG. 3.

The two stacking positions described in relation to FIGS. 2 and 3 are both in the region of the upper rim 30 of the wall 14, at which the wall is significantly strengthened, for instance by increased thickness (as visible toward the left of each figure). This additional thickness results in a downwardly facing surface 32, generally called a "nesting stop" because the stop 32 will engage the top 34 of the rim 30 when a container is being nested within a like container, to ensure that the weight of the nested pile of containers is transferred from the rim 30 of one container, direct to the rim 30 of a container below.

Similarly, the weight of a stack is borne by the rim 30 when the bar 16 is in the position of FIG. 2 or FIG. 3. The rim 30 is adequately strong to prevent buckling or distortion during load.

Figure 4:
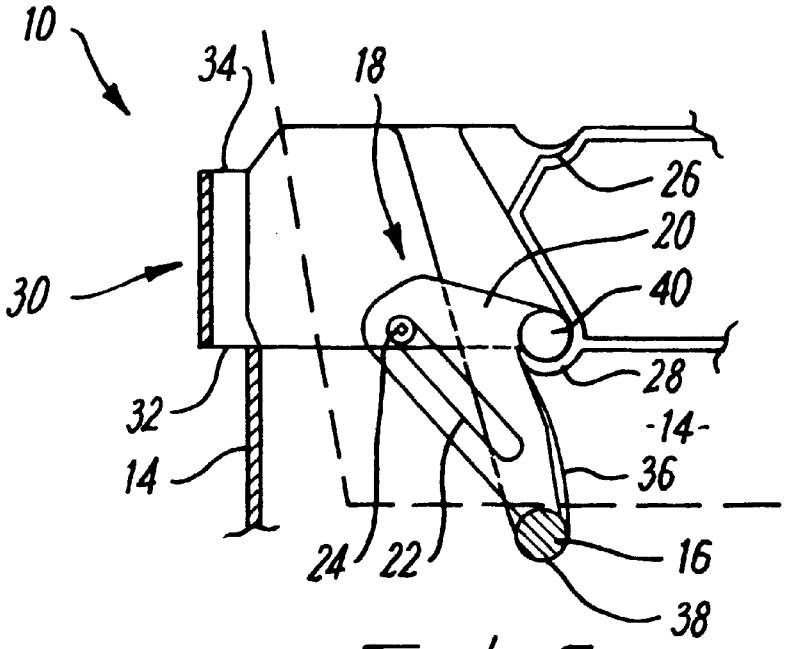

FIG. 4 illustrates a third and lowermost stacking position, as follows. A vertical slot 36 is formed down the wall 14 allowing the bar 16 to move down to the position shown in FIG. 4, by appropriate manipulation of the slot and pin connection 22,24. The bar 16 is then preferably vertically below the position it would occupy when at the ledge 28 or 26.

However, the bottom 38 of the slot 36 is significantly below the rim 30, in a region of the wall 14 which is normally of relatively light material in a conventional container. Consequently, if the bottom 38 was to bear the weight of a stacked container, in a manner such as described above in relation to ledges 26 and 28, there would be a significant danger that the weight would cause the wall 14 to buckle, bow or distort, possibly causing the wall 14 to be damaged, or causing the bar 16 to become disengaged from the wall 14, resulting in an unsafe stack.

Accordingly, the present invention provides additional security in a manner to be now described. First, the plate 20 carries a finger 40 which has a size and shape substantially similar to that of the bar 16 or projection which engages the ledges 26,28. The finger 40 is positioned on the plate 20 so that as the bar 16 approaches the lowermost stacking position (i.e. the bottom 38 of the slot 36) the finger 40 will simultaneously approach the ledge 28, to rest on the ledge. The plate 20 has now reached the position shown in FIG. 4 and is now supported primarily by the ledge 28 (through the finger 40) and by the pin 24. Indeed, it is envisaged that there may be clearance at the bottom 38 around the bar 16 so that the slot 36 takes no part in supporting the plate 20 at this position, or alternatively, the slot 22 could contribute to the support.

By virtue of this support arrangement, it will be apparent that when a like container is stacked by introducing it from above until it rests on the bar 16 (in a manner indicated schematically by broken lines in FIG. 4) the weight supported by the bar 16 will be transferred to the container wall 14 at the height of the finger 40 and pin 24, that is, at a wall position above the stacking position, and within the strengthened part of the wall 14 constituting the rim 30, where the wall is better able to bear the weight. By virtue of some or all of the weight being transferred upwardly in this way, the rim 30 takes sufficient load (preferably the whole load) to remove or minimise any danger of the wall 14 buckling below the rim 30.

Consequently, the invention has shown how an additional stacking position can be provided below the rim 30, without requiring the wall 14 to be strengthened below the rim 30.

Many variations and modifications can be made to the apparatus described above without departing from the scope of the invention. In particular, many other possibilities could be devised for mounting the plate 20 to allow appropriate moving of the bar 16 and indeed, a plate could be replaced with another member. These choices would be influenced in particular by the relative positions of the various stacking positions available. The bar 16 may desirably be movable clear of the mouth of the container, to allow nesting. The finger 40 could engage with the ledge 26 rather than the ledge 28, or with another formation provided for that purpose alone. However, engagement with the ledge 28 is envisaged to form a simple, neat and effective arrangement. It may be possible in some container designs to transfer the weight downwardly or sideways to a position better able to bear the weight.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A container comprising a base, and walls extending upwardly from the base to define a mouth of the container, the container being nestable within a like container below and the walls being provided with a strengthened region which forms an upper rim to provide a nesting stop to limit downward movement into another container when nesting, the container further comprising at least one support member having at least one stacking position to support a second container rested on the support member to form a stack, and moveable clear of the container mouth to allow nesting, at least one of the stacking positions being a low stacking position which is below the upper rim, and the container further comprising mounting means by which the support member is mounted on the container to allow movement between the nesting position and the at least one stacking position, the mounting means comprising a transfer portion connected with the support member to receive substantially the whole weight of the support member and of another container supported by the support member, the transfer portion being formed to engage the upper rim when the support member is in one of the stacking positions which is below the upper rim, to transfer said weight substantially wholly to the upper rim, whereby the weight is supported primarily by the upper rim.

2. A container according to claim 1, wherein there are a plurality of stacking positions to which the support member may move to support a second container at respective heights above the base, the mounting means transferring weight as aforesaid at least when the support member is in the lowermost of the stacking positions.

3. A container according to claim 1, wherein the mounting means transfers weight to a formation which defines another stacking position.

4. A container according to claim 3, wherein the formation comprises a ledge on which a portion of the mounting means or support member may rest when in the corresponding stacking position, and on which an alternative portion may rest when in a different stacking position, to transfer weight as aforesaid.

5. A container according to claim 1, wherein at least two stacking positions are provided.

6. A container according to claim 5, wherein three stacking positions are provided.

* * * * *